US005651420A

United States Patent [19]

Tibbitts et al.

[11] Patent Number: 5,651,420

[45] Date of Patent: Jul. 29, 1997

[54] DRILLING APPARATUS WITH DYNAMIC CUTTINGS REMOVAL AND CLEANING

[75] Inventors: Gordon A. Tibbitts, Salt Lake City; Craig H. Cooley, Bountiful, both of Utah

[73] Assignee: Baker Hughes, Inc., Houston, Tex.

[21] Appl. No.: 407,384

[22] Filed: Mar. 17, 1995

[51] Int. Cl.[6] ..... E21B 4/00; E21B 10/60; E21B 17/10; E21B 17/16

[52] U.S. Cl. ..... 175/102; 175/320; 175/325.5; 175/393

[58] Field of Search ..... 175/393, 320, 175/324, 323, 107, 102, 339, 340, 327

[56] References Cited

U.S. PATENT DOCUMENTS

| | | | |
|---|---|---|---|
| 3,943,997 | 3/1976 | Davis . | |
| 4,105,083 | 8/1978 | Allen . | |
| 4,114,705 | 9/1978 | Milan . | |
| 4,368,787 | 1/1983 | Messenger | 175/324 X |
| 4,373,592 | 2/1983 | Dellinger et al. . | |
| 4,540,055 | 9/1985 | Drummond et al. | 175/323 |
| 4,673,045 | 6/1987 | McCullough . | |
| 4,739,845 | 4/1988 | Dennis . | |
| 4,744,426 | 5/1988 | Reed | 175/324 X |
| 5,143,162 | 9/1992 | Lyon et al. | 175/324 X |

*Primary Examiner*—Stephen J. Novosad
*Attorney, Agent, or Firm*—Trask, Britt & Rossa

[57] ABSTRACT

A drilling apparatus having cuttings removal structure to reduce balling thereof comprising an apparatus body having a connection thereon, and structure for contacting cut potions of the earth formation. The contacting structure may include chip breakers, flexible cables, rotating nozzle assemblies, rotating turbine wheel assemblies, rotating vane assemblies, flails or combinations of these. The apparatus may include elastomeric portions and/or movable potions. The drilling apparatus may comprise a drill bit, drilling stabilizer, drill collar, reamer, downhole motor, etc.

57 Claims, 10 Drawing Sheets

DRILLING APPARATUS WITH DYNAMIC CUTTINGS REMOVAL AND CLEANING

BACKGROUND OF THE INVENTION

1. Field of the Invention

This invention relates to improvements for drilling accessories, drill bits and the like, the improvements having the ability to break cuttings produced from drilling operations and to prevent or remove cuttings or mud solid material accretion on such drilling accessories, drill bits and the like. More specifically, this invention relates to drilling accessories, drill bits and the like having the dynamic capability, either mechanical, hydraulic or both, to break drill cuttings produced from the formations being drilled into smaller, more easily transported cuttings in the drilling fluids, to remove the drilled material and/or solids therefrom or to prevent accretion of material or solids thereon. The invention is particularly useful with drilling accessories, drill bits and the like used in either plastic and sticky rock formations or formations and drilling fluids which tend to build up or accrete on the drilling accessories, bits, and the like.

2. State of the Art

The clogging of the various fluid courses, surfaces and cavities of drilling accessories, drill bits and the like by the highly ductile cuttings produced from drilling operations in plastic formations, or solids from the formations, or solids from the drilling fluid, is typically referred to as "balling," or "bit balling" if it is a drill bit. The drilling of shales or other plastic types of rock formations has always been difficult for all types of downhole drill bits and particularly when using drag type drill bits. The shales, when under pressure and in contact with drilling fluids, tend to act as a sticky mass, and tend to ball or clog cutting surfaces and cavities of the drill bit, thereby reducing the bit's cutting effectiveness. Other formations, when contacted with particular types of drilling fluid systems, can also cause severe balling problems by the drilling fluid system enhancing or enabling the cuttings from the formation to accrete on the drill bit and drilling accessories.

Also, certain types of formations being drilled when subjected to high hydrostatic drilling fluid pressure, such as in highly weighted drilling fluids used at great depths, are highly plastic generating long, ductile cuttings during drilling operations. Unless such cuttings are effectively broken into more manageable, smaller cuttings, the various fluid courses, surfaces and cavities of the drill bit and drilling accessories become clogged, thereby reducing their effectiveness.

One typical prior art approach which deals with such a drag bit balling problem has been to provide large cutters on the bit with strong drilling fluid hydraulics in the proximity of the cutters in an attempt to remove the cuttings from the cutter faces with high-volume, high-velocity hydraulic jet flow of the drilling fluids. For example, see U.S. Pat. No. 4,116,289.

Another prior art attempt to deal with such drag bit balling problem is illustrated in UK Patent GB 2181173A, to Barr et al., entitled "Improvements in or relating to rotary drill bits." It illustrates a bladed drag bit with a plurality of cutters on each blade in combination with a nozzle which creates a vortex flow having a peripheral stream extending across the cutting elements and exiting into a gage region of the bit. The cutters are shown in a spaced relationship and a nozzle is azimuthally disposed in front of each blade. The flow from each nozzle is isolated from the flow of other nozzles on the bit by the solid mass of the adjacent blades. This tends to cause isolation of the hydraulics of each vortex pattern, presents a non-cutting bit surface between the cutters to the sticky formation, and does not provide for a directed hydraulic impingement on the chips, which impingement has a tendency to peel the adhered chips from the cutter faces.

Yet another prior art drag bit for cutting plastic rock formations comprises a plurality of large polycrystalline diamond cutters with each large cutter having a nozzle directing the flow of drilling fluids to each large cutter to apply a force to the chip which is cut by the large cutter. The force tends to peel the chip from the face of the large cutter thereby minimizing the tendency of the bit to ball. Such a bit is illustrated in U.S. Pat. No. 4,913,244.

Still another prior art drag bit for drilling shales and sticky formations comprises a bit body, a plurality of blades formed with the bit body extending therefrom, and at least one cutting element, preferably a plurality of cutters, on each blade. Each cutter has a diamond cutting face to reduce the probability of adhesive contact between the cutters and the plastic, sticky rock formations. Each blade defines a cavity between the blade and the body of the bit, thereby permitting the flow of material therethrough. In this manner, hydraulic removal of cuttings is enhanced to avoid bit balling. To further enhance the hydraulic fluid flow across the bit, one or more nozzles are disposed in the bit body below each of the blades to direct the hydraulic flow of drilling fluids across the cavity and the plurality of cutters disposed on the corresponding blade. Preferably, each nozzle is disposed in the bit body behind the diamond faces of the corresponding plurality of cutters on a blade with respect to the direction of normal rotation of the bit during drilling. In this manner, the chip being sheared from the formation being drilled extrudes upwardly across the diamond face of the cutter to be caught at the upper edge of the cutter by the hydraulic flow from a nozzle located behind the cutter, to effectively peel away the chip from the diamond face into the various waterways and junk slots of the bit. Such a bit is illustrated in U.S. Pat. No. 4,883,132.

While such bits may be effective in the drilling of shales and sticky, plastic rock formations, bit balling may still be a problem in some instances as the bit hydraulic flow may not effectively deal with chip removal from the cutter faces of the bit. In some instances, the hydraulic flow may not be sufficient to peel the chips off the cutter faces, may not be sufficient to break the chips after leaving the cutter faces, or may not be sufficient to cause the removal of large chips, or the instantaneous removal of a high volume of chips from the waterways, face junk slots and junk slots of the bit during drilling operations.

In other instances, the adhesion properties of the components of various drilling fluid systems are sufficient to cause accretion of the drilling fluid solids and attendant formation cuttings on the drill bit surfaces, thereby affecting the drilling performance of the bit drilling tools and initiation of bit balling. These problems can similarly affect the performance of drilling accessories used in drilling operations.

Another prior art drill bit illustrated in U.S. Pat. No. 4,727,946 utilizes brush-like rubbing pads having a plurality of bristles, to provide sealing around the nozzles of the bit face and channel the drilling fluid from the nozzles past the cutting elements of the bit, to help clean the cutting elements.

A drill bit described in U.S. Pat. No. 5,199,511 utilizes an expanding pad to sealingly engage the side of the borehole to seal freshly cut portions of the bottom of the borehole from drilling fluids. The expanding pad of the bit body is formed of an elastomeric material which is reinforced with wire or other reinforcing material and which may have an abrasion-resistant grit embedded therein and/or abrasion resistant pad thereon.

SUMMARY OF THE INVENTION

The present invention relates to drilling accessories, drill bits and the like having the dynamic capability, either mechanical or hydraulic, or both, to break cuttings produced from drilling operations and to prevent the accretion of material from either the drilling fluids or the formation being drilled material, or both, on such drilling accessories, drill bits and the like.

The present invention as it relates to drilling accessories comprises an apparatus body connected in a drill string and having a cleaning apparatus connected to a portion of the apparatus body having the capability, either mechanically, hydraulically, or both, to break cuttings from drilling operations and to prevent the accretion of material thereon, or both.

The present invention as it relates to a drill bit comprises a bit body having a connection at the upper end and a fluid passageway therethrough, a nozzle, and contacting means associated with the bit for contacting cut portions of the earth formation to cause the cut portions to be removed from the bit body and prevent accretion thereon to prevent balling of the bit, as well as to prevent the accretion of solids from the drilling fluid on the bit body. The contacting means comprises movable chip breakers having breaker members thereon, if desired; articulated members; springs; flexible members; flexible cables having frayed ends; weights and/or chip breakers thereon; rotating nozzle assemblies where the energy from the fluid flowing therefrom breaks the chips; rotating vane assemblies or turbine-driven assemblies, where the assembly and/or the energy from the fluid flowing therefrom or the mechanical action of a portion of the assembly breaks the chips, clears accretion of solids from the drilling fluids or combinations thereof.

The contacting means may be used on any drilling accessory, such as drill collars, drilling stabilizers, reamers, downhole motors, etc., as desired, in any desired fluid course, surface, cavity or area to keep them free of the accretion of material and to promote breaking of the formation chips into smaller, more easily transported solids in the drilling fluid.

The present invention also includes the use of flexible elastomeric members, reinforced as desired, in fluid courses, surfaces, areas and cavities of the drilling accessories, drill bits and the like which may be moved by the drilling fluid to prevent the accretion of solids thereon or to help break the chips.

The present invention will be better understood when the drawings are taken in conjunction with the description of the invention set forth hereafter.

DETAILED DESCRIPTION OF THE ILLUSTRATED EMBODIMENT

Figure 1:
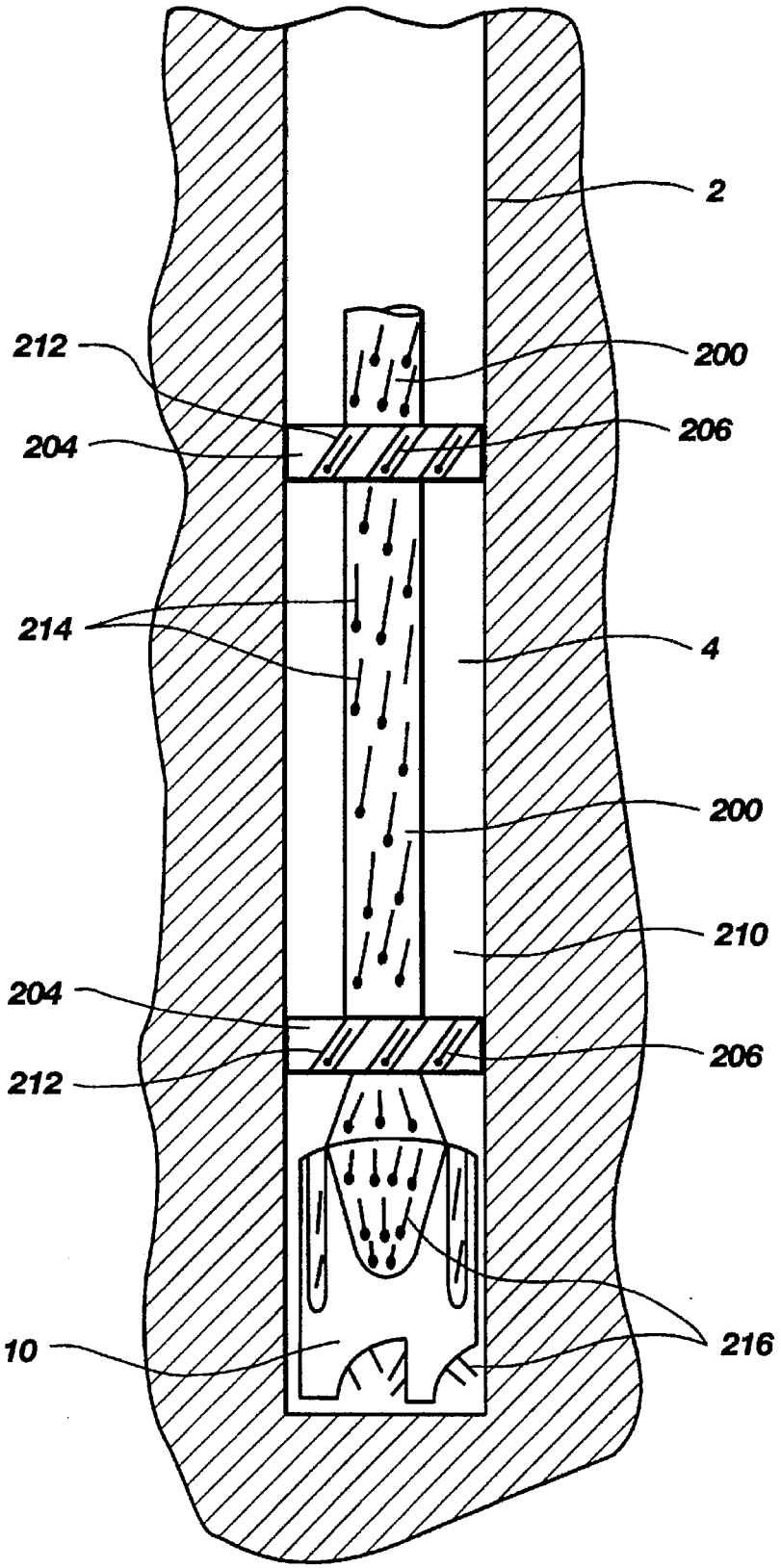
FIG. 1 is a drawing of a drill string having the present invention used on various components thereon.

Referring to drawing FIG. 1, the present invention is shown being used on various components of a drill string.

As shown, a drill bit 10 is drilling a formation borehole 2. The drill bit 10 is connected to the lower end of a drill string 4. The drill string 4 is comprised of a series of drill collars 200 having a plurality of stabilizers 204 located thereon. Each stabilizer 204 is a generally cylindrical annular member connected to a drill collar in the drill string 4. The stabilizer 204 comprises a series of fluid courses or passages 206 on the exterior thereof to allow the flow of drilling fluid and chips and debris contained therein to flow upwardly past the stabilizer 204 in the borehole 2 in the annular space 210 between the drill string 4 and borehole 2. Contained in each fluid passageway 206 of each stabilizer 204 is one or more flails 212 of any suitable type described herein to prevent the clogging of the passageway 206 by the chips and debris from the drilling operation and/or solids from the drilling fluid being used in the drilling operation. Similarly, a plurality of flails 214 are secured to the exterior of the drill collars 200 to prevent the accretion of chips and debris from the drilling operation and/or solids from the drilling fluid thereon. The flails 212 and 214 may be secured to the stabilizers 204 and collars 200 by many suitable means as described herein.

Also, as shown, the drill bit 10 includes a plurality of flails 216 located thereon to break chips formed during the drilling operation and to prevent the accretion of chips and debris from the drilling operation and/or solids from the drilling fluid on the bit. In this manner, the portion of the drill string 4 located near the bit 10 during drilling operations may be used to break chips formed during drilling operations, keeping relatively free of material buildup and thereby increasing the effectiveness of the drilling operation.

Alternatively, rather than having flails 214 located on a drill collar 200 located between two stabilizers 204 in a drill string 4, the flails 214 may be located on the exterior of a downhole motor connected to drill bit 10 having stabilizers 204 located above and below the motor in an arrangement similar to that shown wherein the downhole motor is substituted for the drill collar 200.

Figure 2:
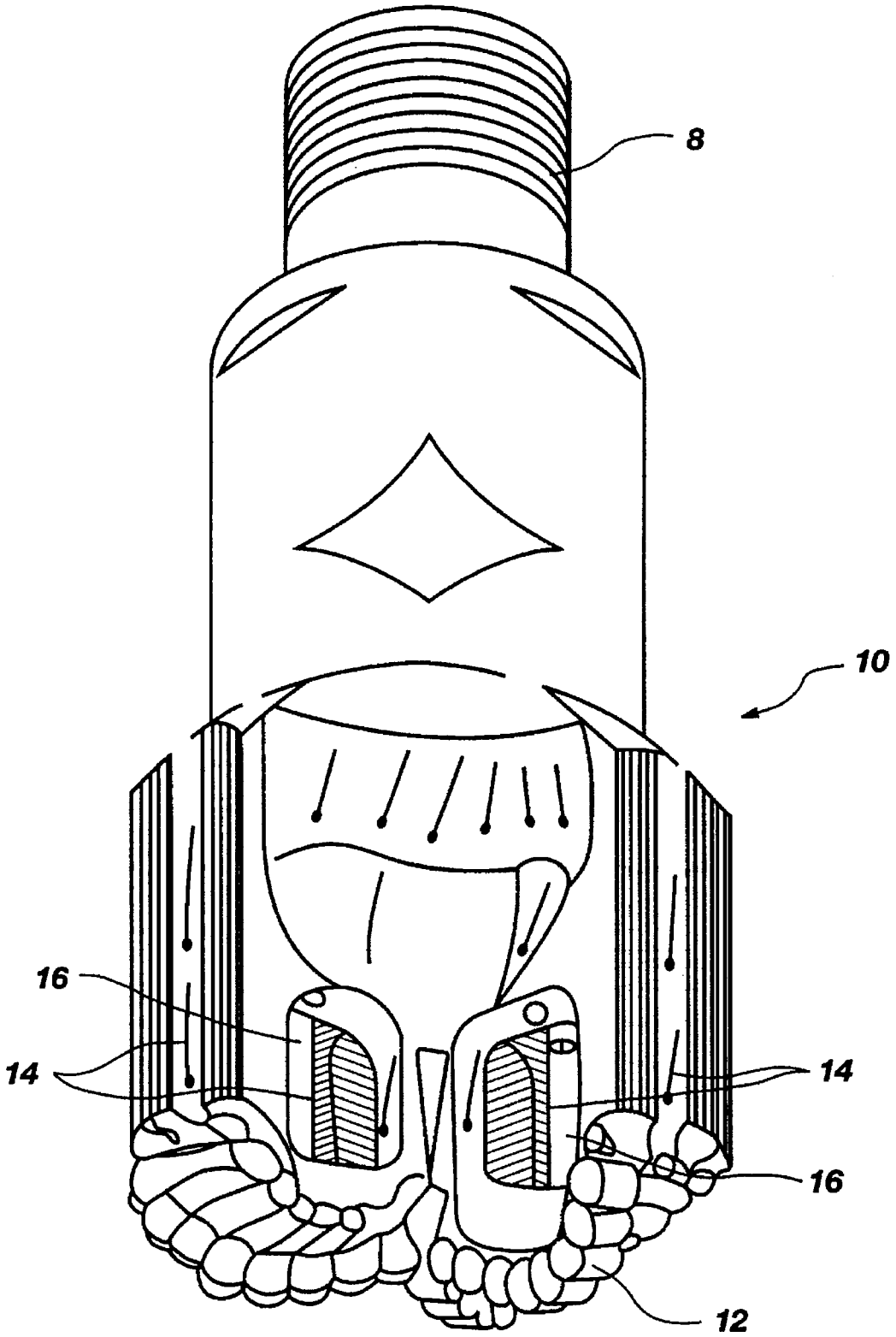
FIG. 2 is a drawing of a bit having a first embodiment of the present invention.

Referring to drawing FIG. 2, drill bit 10 having a threaded pin connection 8 and a plurality of cutters 12 is shown having a first embodiment of the present invention comprising a plurality of tethered cable type flexible flails 14 thereon. The flails 14 are secured to the bit 10 in various desired areas to be displaced by the flow of the drilling fluid to prevent chips and cuttings from the formations being drilled, and/or mud solids from drilling fluids, from building up on the bit 10. The flails 14 may be of any suitable material, such as metal cable, chain, spring wire, plastic, polymeric materials, etc., and may be secured at one end thereof by any suitable means, such as welding, brazing, adhesion, mechanical attachment, etc. If desired, the flails 14 may include suitable members, such as weighted balls, washers with spikes thereon, twisted members, kinked members, spirally wound members, etc., to aid in preventing the buildup of cuttings on the bit 10 and to assist in breaking up the formation chips and cuttings formed during drilling operations and the accretion of drilling fluid solids on the bit body.

Figure 3:
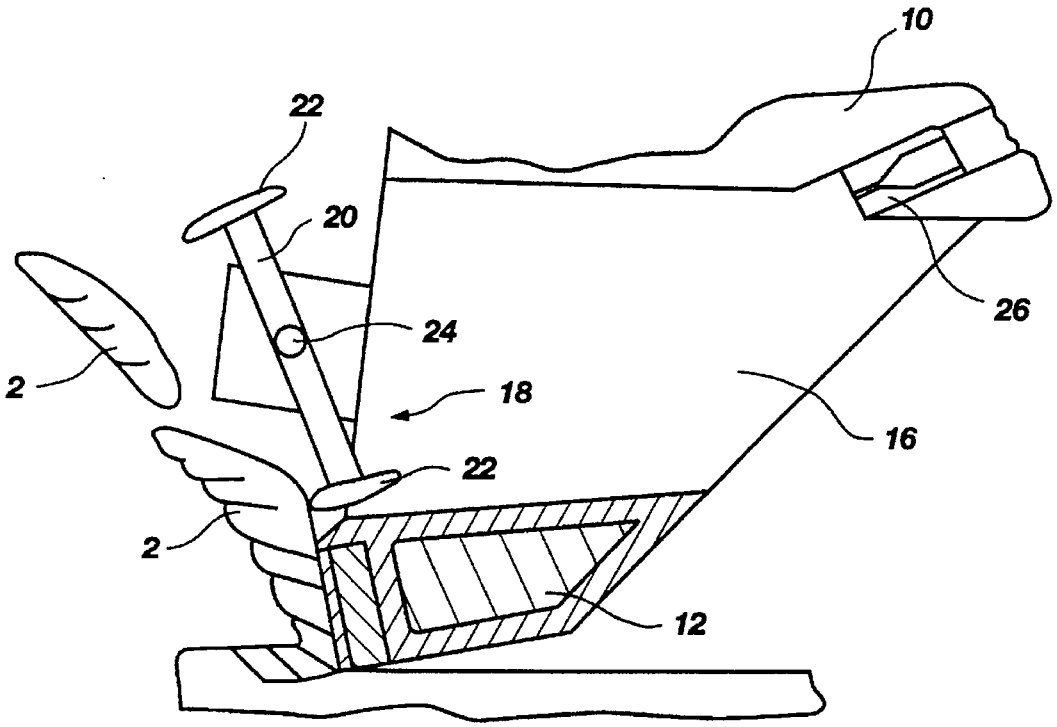
FIG. 3 is a partial cross-sectional view of a bit having a second embodiment of the present invention thereon.

Referring to drawing FIG. 3, a second embodiment of the present invention is shown on a drill bit 10. Mounted in or adjacent an opening or cavity 16 on the drill bit 10 is a rotating chip breaker 18. The chip breaker 18 comprises a pivoting arm 20 having chip breaker members 22 located on the ends thereof to break chips 2 being formed during the drilling of subterranean formations by cutters 12 of the bit 10. The chip breaker members 22 may be of any suitable and desired configuration to break the chips 2 and to clean the opening or cavity 16 in the bit 10. The chip breaker pivoting arm 20 pivots about pivot member 24. The pivot member 24 may be integrally formed with the arm 20 and mate with a suitable recess in a portion of the bit 10 or may be formed on the bit 10 and mate with a suitable recess in arm 20. If desired, the chip breaker 18 may be formed as a closed rectangular member pivoting about its elongated sides 20 within the cavity 16, with the chip breaker members 22 being secured or integrally formed on the ends as well as other portions of the rectangular member.

The chip breaker 18 is caused to rotate through the cavity 16 of the bit 10 by the flow of drilling fluid exiting from nozzle 26 of the bit 10. The hydraulic forces generated by the drilling fluid exiting nozzle 26 also act to help break the chip 2 and clean the cavity 16 of the bit 10. If desired, the nozzle 26 may be a rotating type nozzle assembly as hereinafter described to generate a fluid flow pattern around the cavity 16 of the bit 10.

Figure 4:
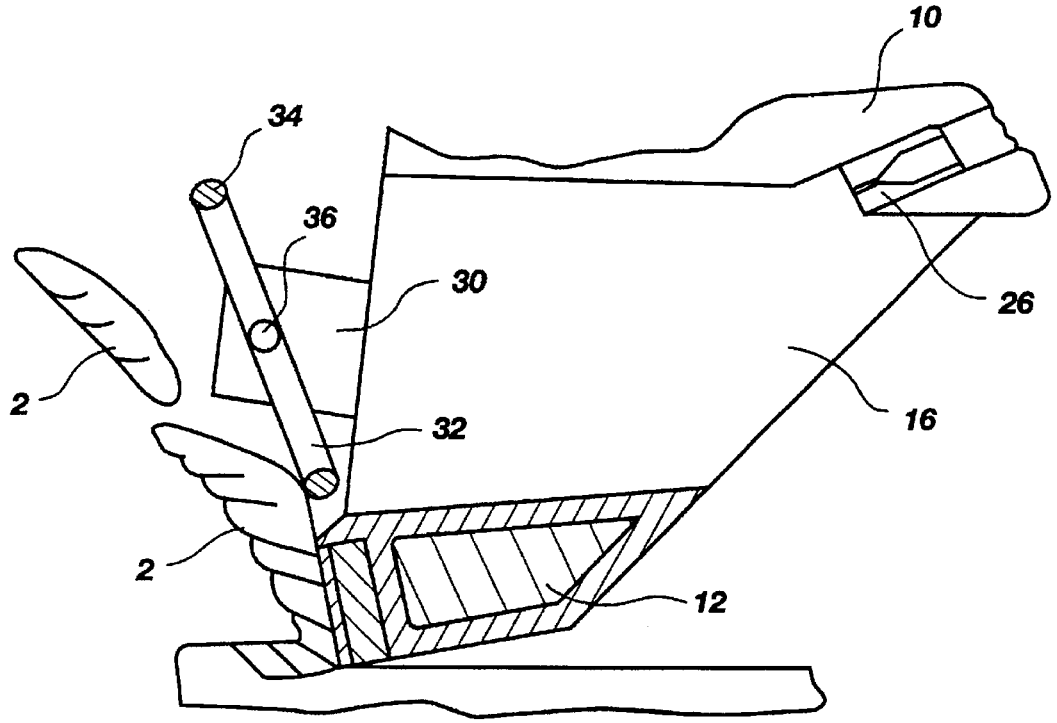
FIG. 4 is a partial cross-sectional view of a bit having a third embodiment of the present invention thereon.

Referring to drawing FIG. 4, a third embodiment of the present invention is shown on a drill bit 10. Mounted in or adjacent an opening or cavity 16 of a drill bit 10 is a closed rectangular shaped rotating chip breaker 30. The chip breaker 30 comprises a pivoting arm 32 having chip breaker members 34 formed by the ends of the closed rectangular shaped chip breaker to break chips 2 being formed during the drilling of subterranean formations by the cutters 12 of the bit 10. The chip breaker pivoting arm 32 pivots about member 36. As previously described, the pivot member 36 may be integrally formed with the arm 32 and mate with a suitable recess in a portion of the bit 10 or may be formed on the bit 10 and mate with a suitable recess in arm 32. The chip breaker 30 is formed as a closed rectangular member pivoting about its elongated sides 32 within the cavity 16, with ends 34 of the closed rectangular member breaking the chips 2. The chip breaker 30 is caused to rotate through the cavity 16 of the bit 10 by the flow of drilling fluid exiting from nozzle 26 of the bit 10. If desired, the nozzle 26 may be a rotating type nozzle assembly to generate a fluid flow pattern around the cavity 16 of the bit 10.

Figure 5:
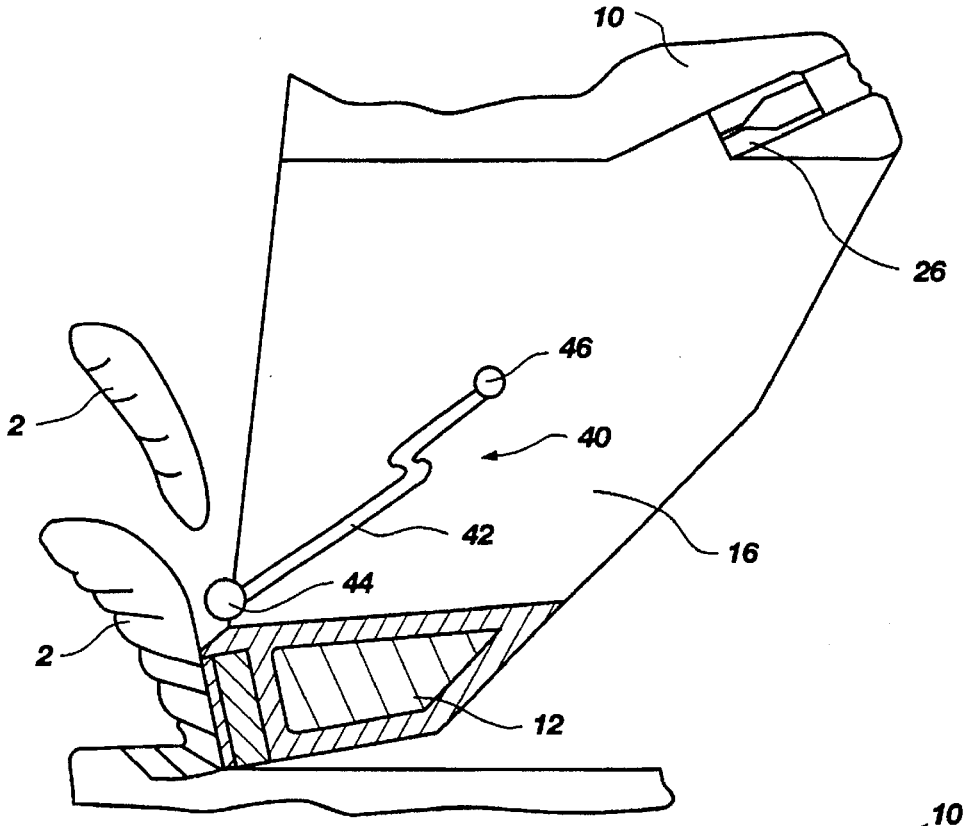
FIG. 5 is a partial cross-sectional view of a bit having a fourth embodiment of the present invention thereon.

Referring to drawing FIG. 5, a fourth embodiment of the present invention is shown within an opening or cavity 16 of a drill bit 10. The chip breaker 40 comprises a flexible cable 42 having a weight 44 secured to one end thereof while the other end thereof is secured at 46 to a wall of the opening or cavity 16 of the bit 10. The cable 42 may be secured at 46 to the wall of the bit 10 by any suitable means, such as welding, brazing, mechanical fastener, etc. The cable 42 as well as the weight 44 on one end thereof may be of any suitable type. The chip breaker 40 is caused to flail about cavity 16 by the flow of drilling fluid from the nozzle 26 of the bit 10. In this manner, chips and drilling debris 2 are broken and are prevented from accumulating within the cavity 16. As previously described, of desired, the nozzle 26 may be a rotating type nozzle assembly to generate a fluid flow pattern within cavity 16. Also, if desired, the cable 42 may be formed as a loop having one or more weights 44 attached thereto (either fixed or slidable thereon) and each end of the loop secured to a wall of the cavity 16 of the bit 10.

Figure 6:
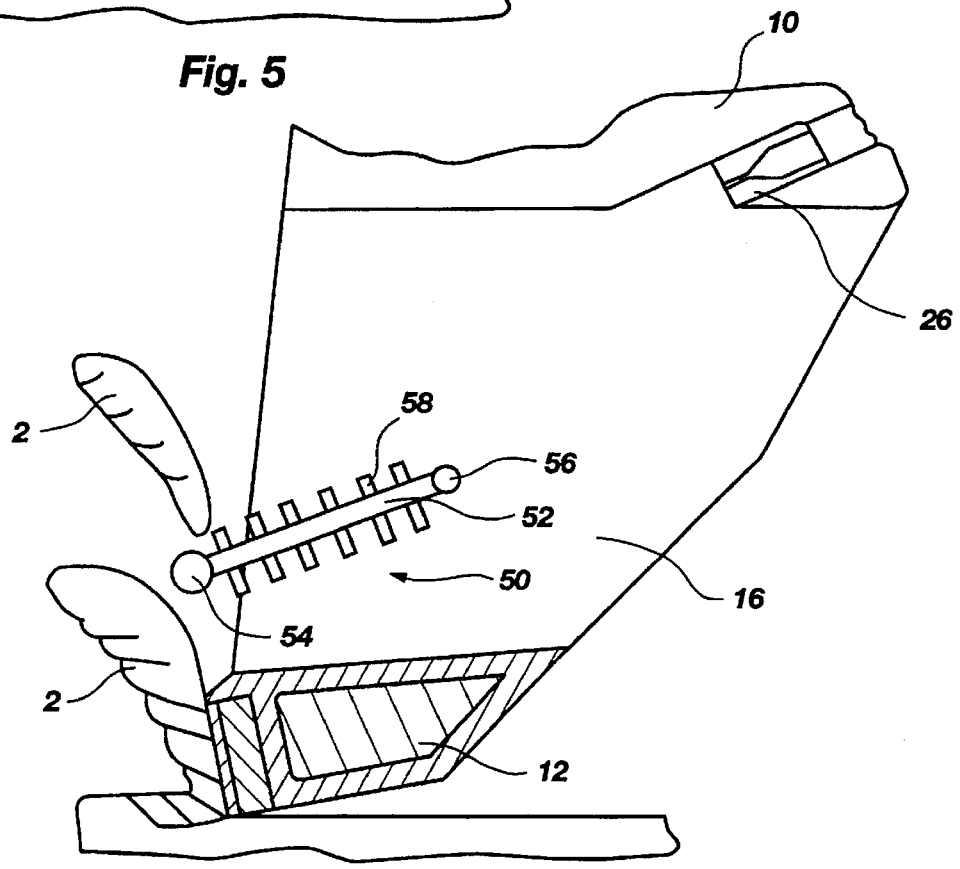
FIG. 6 is a partial cross-sectional view of a bit having a fifth embodiment of the present invention thereon.

Referring to drawing FIG. 6, a fifth embodiment of the present invention is shown in the cavity 16 of a bit 10. The chip breaker 50 comprises a cable loop 52 having one end 56 secured to a wall of the cavity 16 while the other end of the cable loop 52 is secured to another wall (not shown) of cavity 16 of bit 10. The cable loop 52 includes a plurality of chip breakers 58 thereon. The breakers 58 may be in the form of toothed washers, star shaped members, etc. as desired. The breakers 58 may be spaced from each other by suitable spacers installed on the cable loop 52. If desired, a weight 54 may be included as well. As previously described, the chip breaker 50 is caused to rotate within the cavity 16 by the flow of drilling fluids from the nozzle 26 to break chips 2 being cut from the subterranean formation by cutters 12 of bit 10, and to help prevent the buildup of chips and debris within the cavity 16 thereby preventing balling of the bit 10. If desired, the nozzle 26 may be a rotating type nozzle assembly to generate a fluid flow pattern within cavity 16.

Figure 7A:
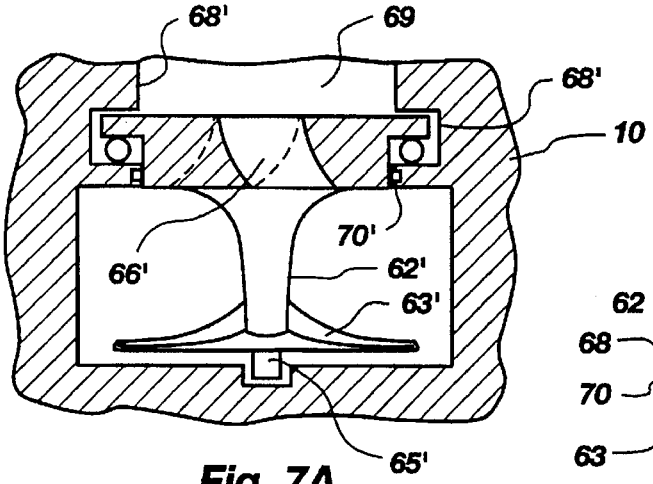
FIG. 7A is a view of a bit having a seventh embodiment of the present invention thereon.
Figure 7:
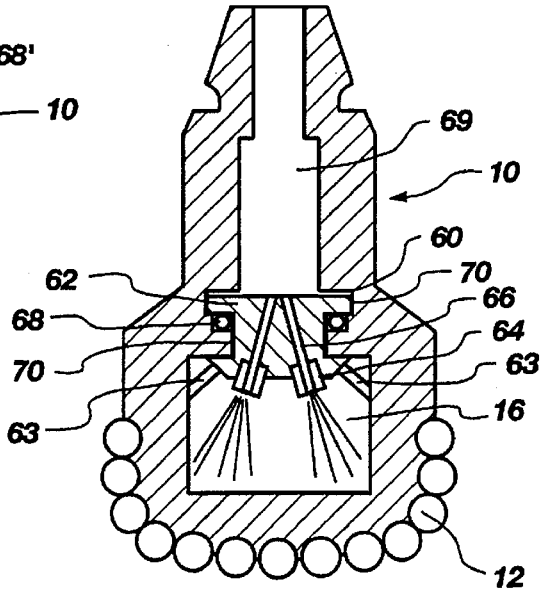
FIG. 7 is a cross-sectional view of a bit having a sixth embodiment of the present invention therein.

Referring to drawing FIG. 7, a bit 10 is shown incorporating a sixth embodiment of the present invention. The bit 10 is formed having one or more internal cavities 16 within which a rotating nozzle assembly 60 provides hydraulic forces to clear cavity 16 of debris and break chips generated during the drilling operations. The rotating nozzle assembly 60 comprises a rotating nozzle body 62 having one or more nozzles 64 therein fed by fluid passages 66 in the nozzle body 62, which receive drilling fluid from plenum 69. The rotating nozzle body 62 rotates via bearing assembly 68 and sealingly engages suitable annular elastomeric seal member 70 installed in bit 10. If desired, the rotating nozzle body 62 may include a plurality of flails 63 secured thereto by any suitable means to clean and break chips and drilling debris from the formations being drilled into smaller chips for removal from the bit body and to prevent the accretion of chips, debris or drilling fluid solids from building up on any portion of the bit 10.

As the rotating nozzle assembly 60 having flails 63 rotates within the bit 10, the drilling fluid flowing from nozzles 64 clears debris and prevents the debris from accreting within the cavity 16 of the bit 10. At the same time, the hydraulic forces generated by the drilling fluid within the cavity 16 and mechanical forces generated by the flails 63 either acting independently or together tend to break chips formed during the drilling operation thereby enhancing the chip removal from the area of the bit 10.

Referring to drawing FIG. 7A, a seventh embodiment of the present invention is shown. A portion of a bit 10 is shown having a rotating nozzle body 62' having fluid passages 66' therein to cause rotation of the nozzle body 62' when fluid flows therethrough. Extending from the central portion of the body 62' are a plurality of cutters, blades or flails 63' to clean and break chips and drilling debris for removal from the bit body and to prevent accretion of chips, debris and drilling fluid solids from building up on interior portions of the bit 10. The drilling fluid flowing through fluid passages 66' helps clean the interior of the drill bit body and break chips, as well as the mechanical action of the flails 63' assisting in the cleaning of the interior of the drill bit body and the breaking of chips. The nozzle body 62' rotates via beating assembly 68' and sealingly engages suitable annular elastomeric seal member 70' installed in bit body 10.

Figure 7B:
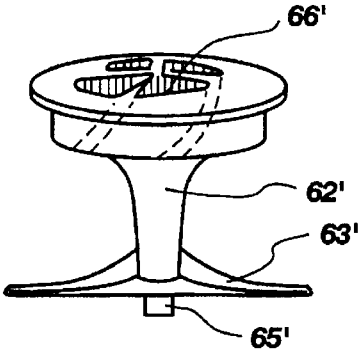
FIG. 7B is a view of a portion of a seventh embodiment of the present invention for use in a bit.

Referring to drawing FIG. 7B, the rotating nozzle body 62' of the seventh embodiment of the present invention is shown. The nozzle body 62' is shown having fluid passages 66' therethrough at the upper portion, and cutters, blades or flails 63' at the lower portion thereof connected to the upper portion via a post portion. Rotation pin 65' is shown on the bottom of nozzle body 62'.

Figure 7C:
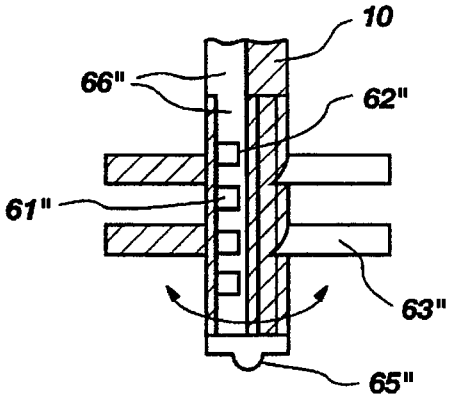
FIG. 7C is a view of a portion of an eighth embodiment of the present invention for use in a bit.

Referring to drawing FIG. 7C, an eighth embodiment of the present invention is shown. A portion of a modified nozzle body 62" is shown. The modified nozzle body portion 62" includes a central fluid passageway 66". The nozzle body portion 62" includes one or more turbine blades and stators 61" secured therein so that drilling fluid flowing through passageway 66" causes rotation of the body portion 62". The nozzle body portion 62" further includes cutters, blades or flails 63" on the exterior thereof to prevent accretion of drilling fluid solids within a bit body and to break chips and drilling debris for easy removal.

Figure 8:
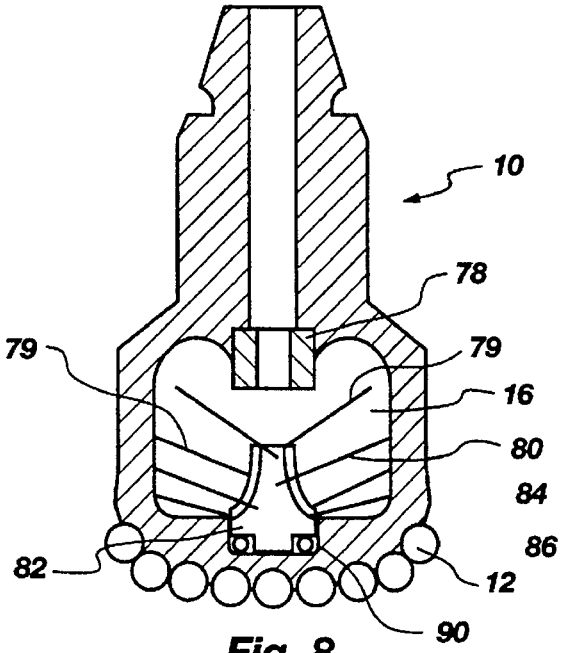
FIG. 8 is a cross-sectional view of a bit having a ninth embodiment of the present invention.

Referring to drawing FIG. 8, a ninth embodiment of the present invention is shown in a bit 10. The bit 10 is formed having one or more internal cavities 16 within which a nozzle 78 directs the flow of drilling fluids in the bit 10 into a rotatable vane assembly 80 installed within the cavity 16 of the bit. The rotatable vane assembly 80 comprises a vane body 82 having a plurality of vanes 84 and channels 86 therebetween. The vane body 82 is rotatably mounted with respect to the bit 10 by beating assembly 88 retained within recess 90 of bit 10.

As the drilling fluid flows from nozzle 78 of bit 10, the vanes 84 and channels 86 cause the stream of drilling fluid impacting thereon to change direction and change the cross-sectional geometry thereby causing the fluid stream to cut and break the chips and debris formed during drilling by bit 10 into smaller chips and debris and to sweep the same from cavity 16 of the bit thereby preventing balling of the bit 10. Again, if desired, a plurality of flails or cutters 79 secured to the vane assembly 80 may be used to cut or break the chips and debris formed during drilling into smaller chips and debris and to prevent the accretion of chips, debris or drilling fluid solids from building up on any portion of the bit 10.

If desired, the nozzle 78 may be made stationary within the bit 10 so that the energy of the drilling fluid as it exits the nozzle 78 breaks or cuts the chips and debris from the drilling operation and sweeps it from the cavity 16 of the bit 10 to prevent balling thereof. The nozzle 78 may also direct the drilling fluid throughout the cavity 16 of the bit 10 to prevent accretion of solids from the drilling fluid or from the chips and debris of the drilling operation in the cavity 16.

Figure 9:
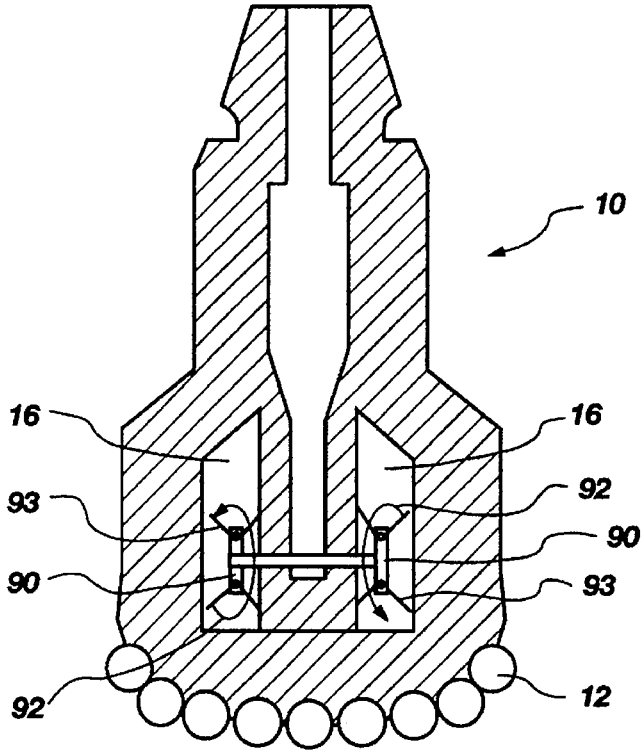
FIG. 9 is a cross-sectional view of a bit having a tenth embodiment of the present invention.

Referring to drawing FIG. 9, a tenth embodiment of the present invention is shown in a bit 10. The bit 10 is formed having one or more internal cavities 16 within which a nozzle 90 directs the flow of drilling fluids in the bit 10 to sweep the cavity 16 free of chips, cuttings and debris and to break the chips, cuttings and debris into smaller chips. The nozzles 90 are rotatable or movable in the directions of the arrows 92 to efficiently sweep the cavity 16 thereby preventing balling of the bit from either drilling chips and debris, or from the accretion of drilling fluid solids. If desired, flails 93 may be secured to movable nozzles 90 by any suitable means to help keep cavity 16 free of material and to break chips, cuttings and debris into smaller portions.

The nozzle 90 of the bit 10 comprises a central shaft rotatable in bit 10, the shaft having a central fluid passageway therethrough communicating with laterally extending nozzles extending therefrom. The drilling fluid flows from opposite sides of the laterally extending portions from the central shaft to cause rotation thereof. Also, the fluid flowing therefrom sweeps drilling chips and debris from cavity 16, and accreting solid materials are broken or swept by the drilling fluid from the interior of the bit 10. Further, the energy of the drilling fluid exiting the lateral nozzles helps break the drilling chips and debris.

Figure 10:
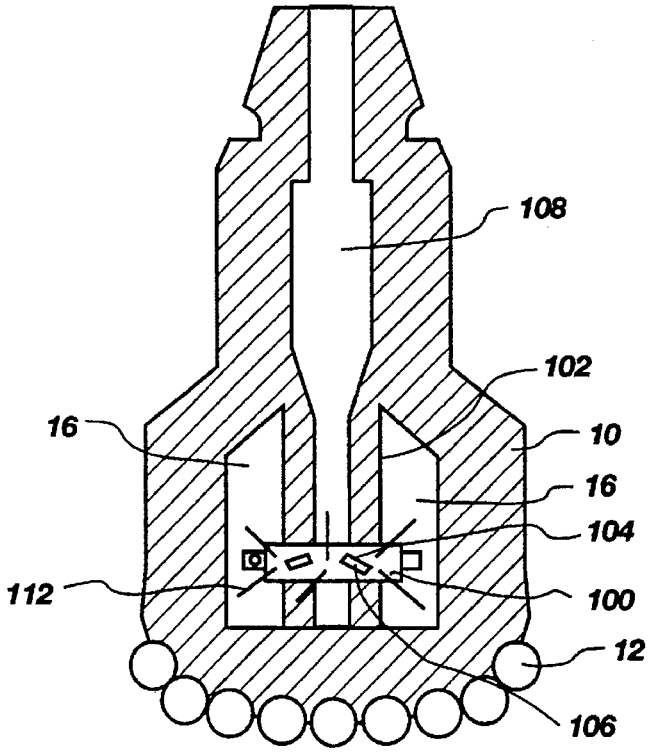
FIG. 10 is a cross-sectional view of a bit having an eleventh embodiment of the present invention.

Referring to drawing FIG. 10, an eleventh embodiment of the present invention is shown in a bit 10. The bit 10 is formed having one or more internal cavities 16 within which a rotating nozzle assembly 100 is mounted on center post 102 of the bit 10. The nozzle assembly 100 is rotatably mounted about center post 102 by any suitable means. The nozzle assembly 100 comprises a housing 104 having a plurality of nozzles 106 mounted thereon which are, in turn, directed at varying angles to cause the flow of drilling fluids from the fluid passageway 108 of the bit 10 to sweep chips, cuttings and debris from the cavity 16 and cause rotation of the housing 104 within the bit 10 thereby preventing balling of the bit 10. If desired, a plurality of flails or fixed blades or cutters 112 may be attached to the housing 104 to help break chips, cuttings and debris as well as clean the cavity 16.

Figure 11:
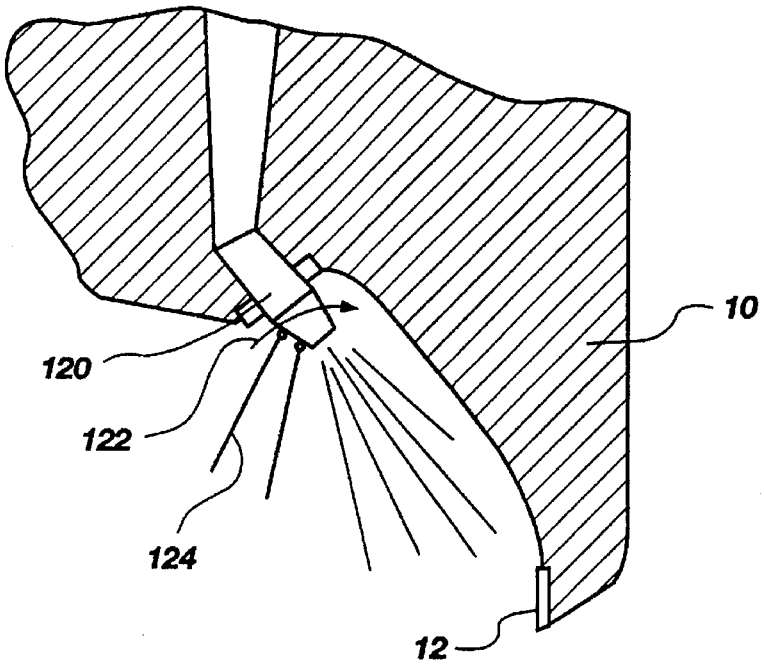
FIG. 11 is a cross-sectional view of a portion of a bit having a twelfth embodiment of the present invention.

Referring to drawing FIG. 11, a twelfth embodiment of the present invention is shown with respect to a portion of a bit 10. A rotatable nozzle assembly 120 is shown mounted in a bit 10 in front of a blade having cutters 12 mounted thereon. The nozzle assembly 120 is free to rotate in the direction of the arrow 122 to cause drilling fluids flowing therefrom to sweep in front of the cutters 12 to break chips, cuttings and debris as well as to sweep the blade and cutters 12 to prevent balling of the bit. The nozzle assembly 120 may also include a plurality of flails 124 attached thereto to assist in breaking the chips, cuttings and debris, and sweeping the blade area to prevent balling of the bit 10. The nozzle assembly 120 is of the same type of construction as described hereinbefore with respect to the nozzle 90 in drawing FIG. 9.

Figure 12:
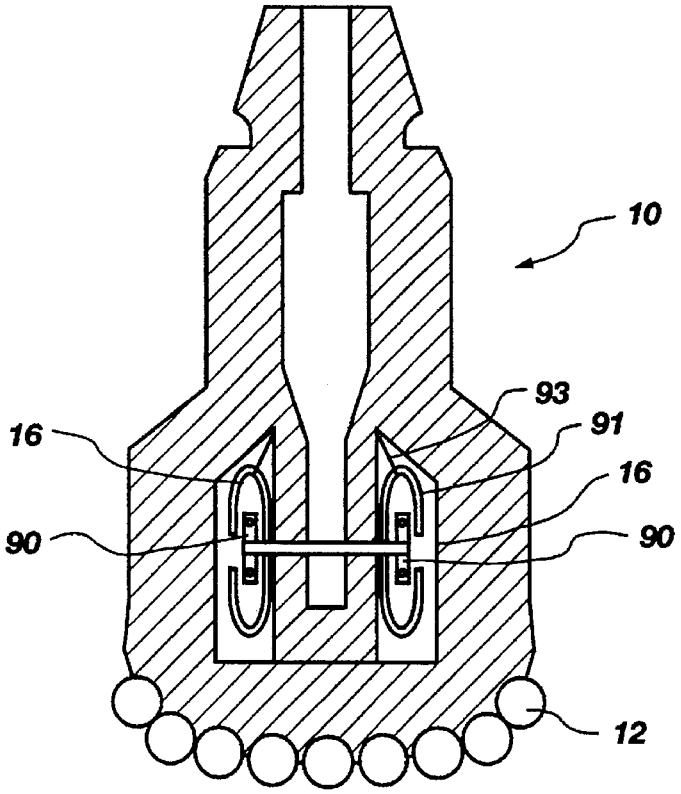
FIG. 12 is a quarter cross-sectional view of a portion of a bit having a thirteenth embodiment of the present invention.

Referring to drawing FIG. 12, a thirteenth embodiment of the present invention is shown with respect to a portion of a bit 10. The bit 10 is formed having one or more internal cavities 16 within which a nozzle 90 directs the flow of drilling fluids in the bit 10 as described hereinbefore to sweep the cavity 16 free of chips, cuttings and debris as well as break the chips, cuttings and debris. Fluid flows through the central rotating shaft out through nozzles 90 to cause rotation of the central shaft and nozzles. Secured to the rotating central shaft at each end thereof are rotating cutters 91 having flails 93 secured thereto to clean the internal cavities 16 and to break any chips, cuttings or debris. The rotating cutters 91 may be of any suitable shape to conform with cavity 16 to rotate therein.

Figure 13:
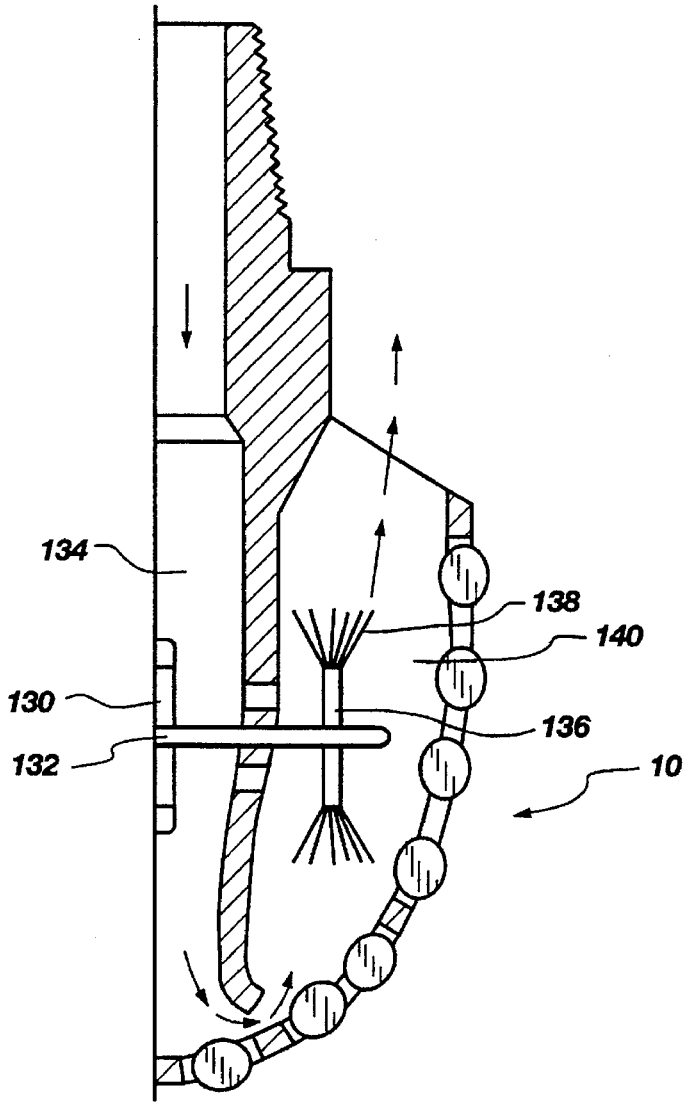
FIG. 13 is a cross-sectional view of a portion of a bit having a fourteenth embodiment of the present invention.

Referring to drawing FIG. 13, a fourteenth embodiment of the present invention is shown with respect to a portion of a bit 10. The bit 10 as shown is a type of drill bit illustrated in U.S. Pat. No. 5,199,511. The bit 10 has been modified to have a suitable turbine 130 mounted on shaft 132 in the center bore 134 of the bit 10. Secured to the ends of shaft 132 are cable type flails 136 having frayed ends 138 thereof to break drilling chips and debris into smaller pieces and to clean cavity 140 of the bit 10 to prevent the accretion of drilling chips and debris and drilling fluids therein. As drilling fluid flows through bore 134 of bit 10 the fluid causes turbine 130 to rotate which, in turn, causes shaft 132 to rotate flails 136. Although cable type flails 136 have been shown, any suitable structure, such as cutters, blades, flails, turbines, etc. may be used to break drilling chips, cuttings, and debris and clean cavity 140.

Figure 14:
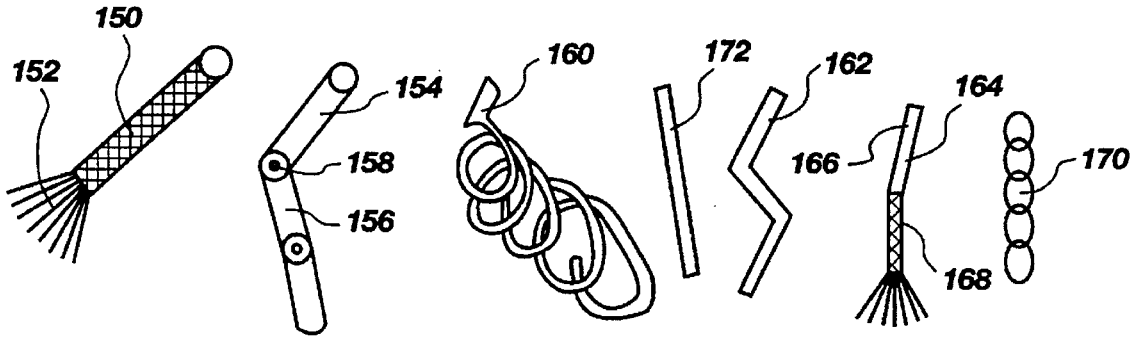
FIG. 14 is a collection of different types of flails for use in the present invention.

Referring to drawing FIG. 14, a number of differing types of flails suitable for use on the various types of drilling apparatus are shown. Flail 150 is a cable type flail having frayed ends 152 thereon. Flail 154 is an articulated flail comprising a plurality of rigid members 156 movably secured at points 158 by any suitable means, such as a pin connection.

Flail 160 is a spiral wound spring type flail.

Flail 162 is a shaped piece of spring wire which, when secured by an end, will flutter in the flow of drilling fluids.

Flail 164 is a combination type flail of a rigid member 166 having a cable type flail portion 168 secured thereto.

Flail 170 is a chain type flail of any suitable type chain.

Flail 172 is a piece of spring wire of any desired length which, when secured by an end, will flutter in the flow of drilling fluids.

Figure 15:
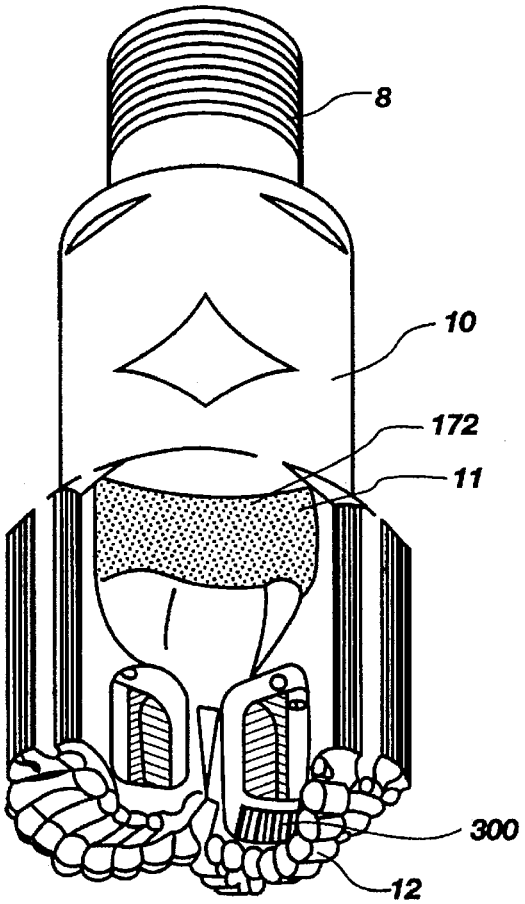
FIG. 15 is a view of a bit having further embodiments of the present invention thereon.

Referring to drawing FIG. 15, a bit 10 is shown having a portion 11 of the junk slot of the bit 10 containing a plurality of spring wire flails 172 mounted in high density to provide a carpet of flails 172 to prevent the accretion of solids from the drilling fluid therein or the accretion of cuttings and debris from the borehole thereon. The bit 10 further comprises an area of flexible elastomeric material 300 which is flexed by the flow of drilling fluid to prevent the accretion of solids from the drilling fluid thereon or the accretion of cuttings and debris from the borehole thereon.

Figure 16A:
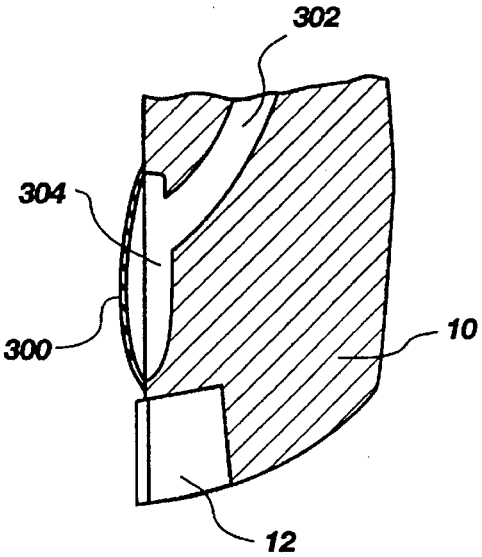
FIG. 16A is a cross-sectional view along line A—A of a bit having the fifteenth embodiment of the invention thereon.
Figure 16:
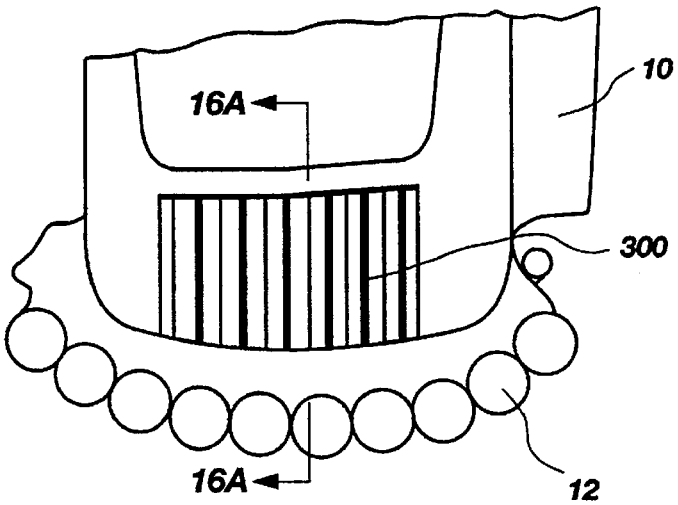
FIG. 16 is a front quarter section view of the fifteenth embodiment of the present invention.

Referring to drawing FIG. 16, a fifteenth embodiment of the present invention is shown on a blade portion of bit 10 having an enlarged area 300 of flexible elastomeric material, the flexible elastomeric material 300 comprising any suitable type, Such as urethane, rubber, neoprene, etc. The elastomeric material may be reinforced with wire or other suitable reinforcing material and may have abrasion resistant grit embedded therein and/or an abrasion resistant pad of metal on a portion thereof. The elastomeric material is mounted over a cavity within bit 10 to allow flexing of the elastomeric material by the drilling fluid therearound. The elastomeric material may be secured to the bit 10 by any suitable means, such as adhesive bonding, mechanical attachment means, etc. If desired, the cavity in the bit 10 behind the elastomeric material may have drilling fluid directed thereto to assist in the flexing of the elastomeric material by the variation in the pressure of the drilling fluid in the bit 10 and the pressure of the drilling fluid in the borehole.

Referring to drawing FIG. 16A, the elastomeric member 300 is shown in cross-section in relation to a bit 10. The elastomeric member 300 is caused to flex by pulsing drilling fluids flowing through passageway 302 in bit 10 into cavity 304 located behind elastomeric member 300. As drilling fluid pressure is increased, the pressure causes elastomeric member 300 to flex, thereby removing any accretion of solids therefrom.

Figure 17:
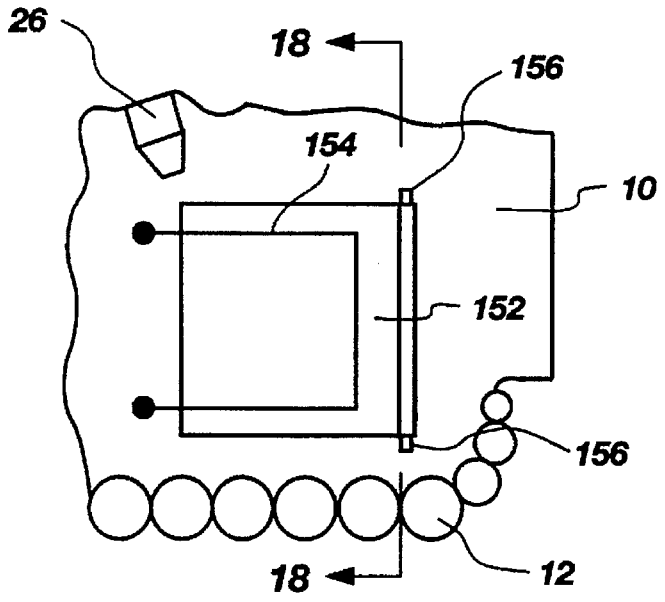
FIG. 17 is a front quarter section view of the sixteenth embodiment of the present invention.
Figure 18:
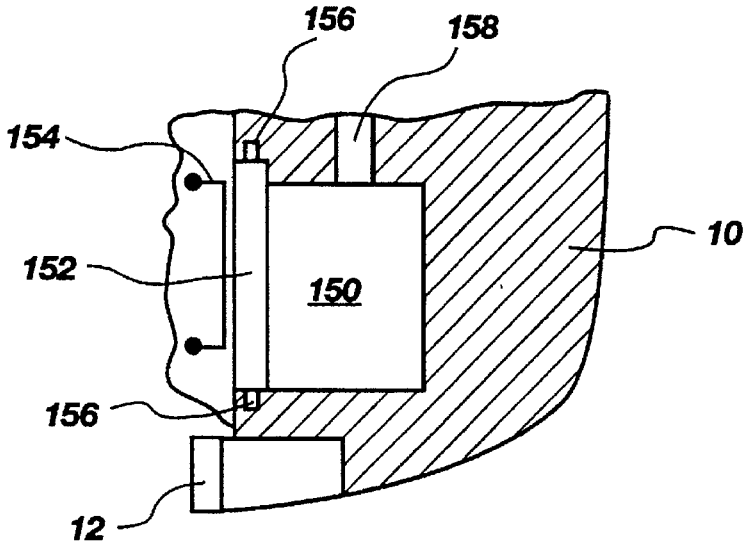
FIG. 18 is a cross-sectional quarter section view along line A—A of the sixteenth embodiment of the present invention.

Referring to drawing FIGS. 17 and 18, a sixteenth embodiment of the present invention is shown on a portion of the blade of a bit 10 having cutters 12 thereon and a nozzle 26 to direct drilling fluid across the cutters 12. The blade of the bit 10 is formed having a cavity 150 therein, the cavity 150 being covered by an expandable opening member, such as pivoting plate 152. The pivoting plate 152 is held in its closed position by resilient member 154, such as a U-shaped wire spring member having the ends of the spring member secured to a portion of the bit 10 by any suitable means, such as welding, blazing, etc. The pivoting plate 152 pivots about pivot pins 156 retained in suitable cavities in a portion of the bit 10.

The cavity 150 in the blade of the bit 10 is connected via passageway 158 to be supplied with drilling fluid. When it is desired to remove any material which may have accreted on pivoting plate 152, the flow of drilling fluid through the bit 10 is increased thereby increasing the fluid pressure in cavity 150 to force the plate 152 to pivot about pins 156 and open, thereby causing the U-shaped spring 154 to scrape across the plate 152 removing material therefrom. When the flow of drilling fluid is decreased, the U-shaped spring 154 biases the pivoting plate into its original position in the blade of the bit 10 covering the cavity 150. The spring 154 may contain suitable types of scraping members thereon to enhance its scraping ability.

Rather than use a U-shaped spring member 154, any suitable shaped resilient member which is capable of closing pivoting plate 152 and scraping material from the surface of the plate 152 may be used, such as a resilient T-shaped member.

It should be understood that various combinations of the different embodiments of the present invention may be used in a bit 10. For instance, the flails 14 may be used in combination with the chip breakers 18, 30, 40, 50, nozzle assembly 60, vane assembly 80, nozzles 90 and nozzle assemblies 100 and 120 as described hereinbefore wherever desired so long as no interference exists. Similarly, the rotating chip nozzle assembly 60 may be used with any of the chip breakers such as 18, 30, 40 and 50 for greater effectiveness.

Also, while the present invention has been described with respect to drag type bits, it is applicable to any type drill bit, such as tri-cone rock bits, coring bits, etc. Additionally, the present invention may be used on various drilling accessories to clean passageways thereon and to help prevent the accretion of solids from drilling operations as well as from drilling fluids thereon. Such types of drilling accessories upon which the present invention may be used are drill collars, drilling stabilizers, reamers, downhole motors, etc.

It should be understood that various changes, additions, deletions, and modifications to the present invention may be made which will fall within the scope of the claimed invention hereafter.

What is claimed is:

1. A drill bit used in a drill string for drilling a borehole in an earth formation, said drilling causing said earth formation to be broken or cut into chips and debris which are transported by the flow of drilling fluid in said borehole, said drill bit comprising:

an apparatus body having at least one connection structure thereon adapted to connect said body in said drill string and an interior passage for said flow of said drilling fluid therethrough, said apparatus body having a surface area contacted by said chips and debris transported by said flow of drilling fluid in said borehole; and apparatus secured to a portion of said surface area of said apparatus body, said apparatus movable in said flow of drilling fluid over said surface area to break said chips and debris and to prevent the accretion of said chips and debris or portions of said drilling fluids in said surface area.

2. The drill bit of claim 1, wherein said surface area is an area formed by at least two opposed surfaces.

3. The drill bit of claim 2, wherein said apparatus comprises:

a moveable chip breaker secured to said apparatus body having a portion extending into said surface area.

4. The drill bit of claim 3, wherein said moveable chip breaker comprises:

a moveable arm secured to a portion of said apparatus body having a portion extending into said surface area.

5. The drill bit of claim 3, wherein said moveable chip breaker comprises:

a closed member secured to a portion of said apparatus body having a portion rotatable in said surface area.

6. The drill bit of claim 2, wherein said apparatus comprises:

a nozzle assembly to direct a portion of said flow of drilling fluid into a portion of said surface area.

7. The drill bit of claim 2, wherein said apparatus comprises:

a rotating nozzle assembly to direct a portion of said flow of drilling fluid into a portion of said surface area between said at least two opposed surfaces.

8. The drill bit of claim 7, wherein said rotating nozzle further comprises:

a plurality of flexible members secured thereto having a portion thereof extending into said surface area.

9. The drill bit of claim 2, wherein said apparatus comprises:

a rotating vane assembly to direct a portion of said flow of drilling fluid into a portion of said surface area between said at least two opposed surfaces, said rotating vane being driven by the force of said drilling fluid.

10. The drill bit of claim 2, further comprising:

at least one rotating nozzle to direct a portion of said flow of drilling fluid into a portion of said surface area.

11. The drill bit of claim 2, wherein said apparatus comprises:

a flexible member secured to said apparatus body having a portion thereof extending into said surface area.

12. The drill bit of claim 11, wherein said flexible member comprises:

an elastomeric member secured to a portion of said bit.

13. The drill bit of claim 11, wherein said flexible member comprises:

a moveable member having a portion thereof secured to said bit.

14. The drill bit of claim 1, wherein said apparatus comprises:

a moveable chip breaker secured to said apparatus body having a portion extending into said surface area.

15. The drill bit of claim 14, wherein said moveable chip breaker comprises:

a moveable arm secured to a portion of said apparatus body having a portion extending into said surface area, said moveable arm having a chip breaker member on at least one end thereof.

16. The drill bit of claim 14, wherein said movable chip breaker comprises:

a closed member secured to a portion of said apparatus body having a portion moveable in said surface area.

17. The drill bit of claim 16, wherein said movable chip breaker further comprises:

a chip breaker member attached to a portion of said closed member.

18. The drill bit of claim 1, wherein said apparatus comprises:

a flexible member secured to said apparatus body having a portion thereof extending into said surface area.

19. The drill bit of claim 1, further comprising:

a rotational member rotationally supported by a portion of said drill bit having a portion thereof in fluid communication with the interior passage for said flow of said drilling fluid therethrough of said drill bit, the rotational member being rotated in said drill bit by said flow of said drilling fluid therethrough.

20. The drill bit of claim 19, wherein the rotational member comprises:

a turbine wheel-type rotational member having said flow of said drilling fluid through at least one aperture therein to cause rotation of the rotational member.

21. The drill bit of claim 19, wherein the rotational member comprises:

a turbine wheel-type rotational member having said flow of said drilling fluid over a portion thereof to cause rotation of the rotational member.

22. A drilling apparatus used in a drill string for drilling a borehole in an earth formation, said drilling causing said earth formation to be broken or cut into chips and debris which are transported by the flow of drilling fluid in said borehole, said drilling apparatus comprising:

an apparatus body having at least one connection structure thereon adapted to connect said body in said drill string and an interior passage for said flow of said drilling fluid therethrough, said apparatus body having an exterior surface area contacted by said chips and debris transported by said flow of drilling fluid in said borehole; and apparatus secured to a portion of said exterior surface area of said apparatus body, said apparatus movable in said flow of drilling fluid over said exterior surface area to break said chips and debris and to prevent the accretion of said chips and debris or portions of said drilling fluids in said exterior surface area.

23. The drilling apparatus of claim 22, wherein said surface area is an area formed by at least two opposed surfaces.

24. The drilling apparatus of claim 23, wherein said apparatus comprises:

a nozzle assembly to direct a portion of said flow of drilling fluid into a portion of said surface area.

25. The drilling apparatus of claim 23, wherein said apparatus comprises:

a rotating nozzle assembly to direct a portion of said flow of drilling fluid into a portion of said area between said at least two opposed juxtaposed surfaces.

26. The drilling apparatus of claim 24, wherein said rotating nozzle further comprises:

a plurality of flexible members secured thereto having a portion thereof extending into said area.

27. The drilling apparatus of claim 23, wherein said apparatus comprises:

a rotating vane assembly to direct a portion of said flow of drilling fluid into a portion of said area between said exterior surface at least two opposed surfaces, said rotating vane being driven by the force of said drilling fluid.

28. The drilling apparatus of claim 22, wherein said apparatus comprises:

a moveable chip breaker secured to said surface of said apparatus body having a portion extending into said surface area.

29. The drilling apparatus of claim 28, wherein said moveable chip breaker comprises:

a moveable arm secured to a portion of said apparatus body having a portion extending into said surface area, said moveable arm having a chip breaker member on at least one end thereof.

30. The drilling apparatus of claim 28, wherein said movable chip breaker comprises:

a closed member secured to a portion of said apparatus body having a portion moveable in said surface area.

31. The drilling apparatus of claim 30, wherein said movable chip breaker further comprises:

a chip breaker member attached to a portion of said closed member.

32. The drilling apparatus of claim 22, wherein said apparatus comprises:

a flexible member secured to said apparatus body having a portion thereof extending into said surface area.

33. The drilling apparatus of claim 22, wherein said drilling apparatus comprises a stabilizer.

34. The drilling apparatus of claim 22, wherein said drilling apparatus comprises a drill collar.

35. The drilling apparatus of claim 22, wherein said drilling apparatus comprises a drilling motor.

36. The drilling apparatus of claim 22, further comprising:

a rotational member rotationally supported by a portion of said drilling apparatus having a portion thereof in fluid communication with the interior passage for said flow of said drilling fluid therethrough of said drilling apparatus, the rotational member being rotated in said drilling apparatus by said flow of said drilling fluid therethrough.

37. The drilling apparatus of claim 36, wherein the rotational member comprises:

a turbine wheel-type rotational member having said flow of said drilling fluid through at least one aperture therein to cause rotation of the rotational member.

38. The drilling apparatus of claim 36, wherein the rotational member comprises:

a turbine wheel-type rotational member having said flow of said drilling fluid over a portion thereof to cause rotation of the rotational member.

39. A drilling apparatus used in a drill string for drilling a bore hole in an earth formation, said drilling causing said earth formation to be broken or cut into chips and debris which are transported by the flow of drilling fluid in said borehole, said drilling apparatus comprising:

an apparatus body having at least one connection structure thereon adapted to connect said body in said drill string and an interior passage for said flow of said drilling fluid therethrough, said apparatus body having a surface area contacted by said chips and debris transported by said flow of drilling fluid in said borehole; and a moveable arm secured to a portion of said apparatus body having a portion extending into said surface area, said moveable arm having a chip breaker member on at least one end thereof.

40. A drilling apparatus used in a drill string for drilling a borehole in an earth formation, said drilling causing said earth formation to be broken or cut into chips and debris which are transported by the flow of drilling fluid in said borehole, said drilling apparatus comprising:

an apparatus body having at least one connection structure thereon adapted to connect said body in said drill string and an interior passage for said flow of said drilling fluid therethrough, said apparatus body having a surface area contacted by said chips and debris transported by said flow of drilling fluid in said borehole; and a closed member secured to a portion of said apparatus body having a portion moveable in said surface area.

41. The drilling apparatus of claim 40, wherein said closed member further comprises:

a chip breaker member attached to a portion of said closed member.

42. A drilling apparatus used in a drill string for drilling a borehole in an earth formation, said drilling causing said earth formation to be broken or cut into chips and debris which are transported by the flow of drilling fluid in said borehole, said drilling apparatus comprising:

an apparatus body having at least one connection structure thereon adapted to connect said body in said drill string and an interior passage for said flow of said drilling fluid therethrough, said apparatus body having a surface area contacted by said chips and debris transported by said flow of drilling fluid in said borehole; and a flexible member secured to said apparatus body having a portion thereof extending into said surface area.

43. A drilling apparatus used in a drill string for drilling a bore hole in an earth formation, said drilling causing said earth formation to be broken or cut into chips and debris which are transported by the flow of drilling fluid in said borehole, said drilling apparatus comprising:

an apparatus body having at least one connection structure thereon adapted to connect said body in said drill string and an interior passage for said flow of said drilling fluid therethrough, said apparatus body having a surface area formed by at least two opposed surfaces contacted by said chips and debris transported by said flow of drilling fluid in said borehole; and a movable nozzle assembly to direct a portion of said flow of drilling fluid into a portion of said surface area formed by at least two opposed surfaces, said flow of drilling fluid from said movable nozzle contacting said chips and debris to break said chips and debris and to prevent accretion of said chips and debris or portions of said drilling fluid in said surface area formed by said at least two opposed surfaces.

44. A drilling apparatus used in a drill string for drilling a bore hole in an earth formation, said drilling causing said earth formation to be broken or cut into chips and debris which are transported by the flow of drilling fluid in said borehole, said drilling apparatus comprising:

an apparatus body having at least one connection structure thereon adapted to connect said body in said drill string and an interior passage for said flow of said drilling fluid therethrough, said apparatus body having a surface area formed by at least two opposed surfaces contacted by said chips and debris transported by said flow of drilling fluid in said borehole; and a rotating nozzle assembly to direct a portion of said flow of drilling fluid into a portion of said area between said at least two opposed surfaces.

45. The drilling apparatus of claim 44, wherein said rotating nozzle further comprises:

a plurality of flexible members secured thereto having a portion thereof extending into said surface area.

46. A drilling apparatus used in a drill string for drilling a bore hole in an earth formation, said drilling causing said earth formation to be broken or cut into chips and debris which are transported by the flow of drilling fluid in said borehole, said drilling apparatus comprising:

an apparatus body having at least one connection structure thereon adapted to connect said body in said drill string and an interior passage for said flow of said drilling fluid therethrough, said apparatus body having a surface area formed by at least two opposed surfaces contacted by said chips and debris transported by said flow of drilling fluid in said borehole; and a rotating vane assembly to direct a portion of said flow of drilling fluid into a portion of said area between said at least two opposed surfaces, said rotating vane being driven by the force of said drilling fluid.

47. A stabilizer used in a drill string for drilling a borehole in an earth formation, said drilling causing said earth formation to be broken or cut into chips and debris which are transported by the flow of drilling fluid in said borehole, said stabilizer comprising:

an apparatus body having at least one connection structure thereon adapted to connect said body in said drill string and an interior passage for said flow of said drilling fluid therethrough, said apparatus body having a surface area contacted by said chips and debris transported by said flow of drilling fluid in said borehole; and apparatus secured to a portion of said surface area of said apparatus body, said apparatus movable in said flow of drilling fluid over said surface area to break said chips and debris and to prevent the accretion of said chips and debris or portions of said drilling fluid in said surface area.

48. A drill collar used in a drill string for drilling a borehole in an earth formation, said drilling causing said earth formation to be broken or cut into chips and debris which are transported by the flow of drilling fluid in said borehole, said drill collar comprising:

an apparatus body having at least one connection structure thereon adapted to connect said body in said drill string and an interior passage for said flow of said drilling fluid therethrough, said apparatus body having a surface area contacted by said chips and debris transported by said flow of drilling fluid in said borehole; and apparatus secured to a portion of said surface area of said apparatus body, said apparatus movable in said flow of drilling fluid over said surface area to break said chips and debris and to prevent the accretion of said chips and debris or portions of said drilling fluid in said surface area.

49. A drilling motor used in a drill string for drilling a borehole in an earth formation, said drilling causing said earth formation to be broken or cut into chips and debris which are transported by the flow of drilling fluid in said borehole, said drilling motor comprising:

an apparatus body having at least one connection structure thereon adapted to connect said body in said drill string and an interior passage for said flow of said drilling fluid therethrough, said apparatus body having a surface area contacted by said chips and debris transported by said flow of drilling fluid in said borehole; and apparatus secured to a portion of said surface area of said apparatus body, said apparatus movable in said flow of drilling fluid over said surface area to break said chips and debris and to prevent the accretion of said chips and debris or portions of said drilling fluid in said surface area.

50. A drilling apparatus used in a drill string for drilling a borehole in an earth formation, said drilling causing said earth formation to be broken or cut into chips and debris which are transported by the flow of drilling fluid in said borehole, said drilling apparatus comprising:

an apparatus body having at least one connection structure thereon adapted to connect said body in said drill string and an interior passage for said flow of said drilling fluid therethrough, said apparatus body having a surface area contacted by said chips and debris transported by said flow of drilling fluid in said borehole;

apparatus secured to a portion of said surface area of said apparatus body, said apparatus movable in said flow of drilling fluid over said surface area to break said chips and debris and to prevent the accretion of said chips and debris or portions of said drilling fluid in said surface area; and a rotational member rotationally supported by a portion of said drilling apparatus having a portion thereof in fluid communication with the interior passage for said flow of said drilling fluid therethrough of said drilling apparatus, the rotational member being rotated in said drilling apparatus by said flow of said drilling fluid therethrough.

51. The drilling apparatus of claim 50, wherein the rotational member comprises:

a turbine wheel-type rotational member having said flow of said drilling fluid through at least one aperture therein to cause rotation of the rotational member.

52. The drilling apparatus of claim 50, wherein the rotational member comprises:

a turbine wheel-type rotational member having said flow of said drilling fluid over a portion thereof to cause rotation of the rotational member.

53. A drilling apparatus used in a drill string for drilling a borehole in an earth formation, said drilling causing said earth formation to be broken or cut into chips and debris which are transported by the flow of drilling fluid in said borehole, said drilling apparatus comprising:

an apparatus body having at least one connection structure thereon adapted to connect said body in said drill string and an interior passage for said flow of said drilling fluid therethrough, said apparatus body having a surface portion contacted by said chips and debris, said apparatus body selected from the apparatus group consisting of a drill bit, drill motor, drill collar or drill string stabilizer; and flexible, movable apparatus secured to a portion of said surface portion of said apparatus body, said apparatus movable in said flow of drilling fluid over said surface portion to break said chips and debris and to prevent the accretion of said chips and debris or portions of said drilling fluids on said surface portion.

54. The drilling apparatus of claim 53, wherein said apparatus comprises:

a moveable chip breaker secured to said apparatus body having a portion extending into said surface portion.

55. The drilling apparatus of claim 54, wherein said apparatus comprises:

a flexible member secured to said apparatus body having a portion thereof extending into said surface portion.

56. The drilling apparatus of claim 54 wherein said apparatus comprises:

a nozzle assembly to direct a portion of said flow of drilling fluid into a portion of said surface portion.

57. The drilling apparatus of claim 56, wherein said rotating nozzle further comprises:

a plurality of flexible members secured thereto having a portion thereof extending into said surface portion.

* * * * *

UNITED STATES PATENT AND TRADEMARK OFFICE

CERTIFICATE OF CORRECTION

PATENT NO. : 5,651,420

DATED : July 29, 1997

INVENTOR(S) : Gordon A. Tibbitts, et al.

It is certified that error appears in the above-identified patent and that said Letters Patent is hereby corrected as shown below:

| | |
|---|---|
| Abstract, line 4 | change "potions" to --portions-- |
| Abstract, line 8 | change "potions" to --portions-- |
| Col. 7, line 31 | change "beating" to --bearing-- |
| Col. 7, line 59 | change "beating" to --bearing-- |
| Col. 9, line 66 | change "Such" to --such-- |
| Col. 13, line 12 | after "opposed" delete --juxtaposed-- |
| Col. 13, line 13 | change "24" to --25-- |
| Col. 13, line 16 | after "said" insert --surface-- |

Signed and Sealed this

Twenty-fourth Day of March, 1998

*Attest:*

Bruce Lehman

BRUCE LEHMAN

*Attesting Officer*

*Commissioner of Patents and Trademarks*